US009277824B2

(12) United States Patent
Breen et al.

(10) Patent No.: US 9,277,824 B2
(45) Date of Patent: Mar. 8, 2016

(54) REVERSE DRIVE ASSEMBLY FOR RECLINER POWER MECHANISM

(71) Applicant: Ashley Furniture Industries, Inc., Arcadia, WI (US)

(72) Inventors: John R. Breen, Eleva, WI (US); Peter J. Fynboh, Saint Charles, MN (US); Jeffrey Cooper, Independence, WI (US); Joseph L. Anibas, Alma Center, WI (US); Nicholas J. Robinson, Ettrick, IA (US); Richard E. Gorka, Ettrick, WI (US); Lucas R. Walz, Ettrick, WI (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 171 days.

(21) Appl. No.: 14/044,592

(22) Filed: Oct. 2, 2013

(65) Prior Publication Data

US 2014/0091601 A1 Apr. 3, 2014

Related U.S. Application Data

(60) Provisional application No. 61/708,993, filed on Oct. 2, 2012, provisional application No. 61/802,025, filed on Mar. 15, 2013.

(51) Int. Cl.

| | |
|---|---|
| ***A47C 1/032*** | (2006.01) |
| ***A47C 1/02*** | (2006.01) |
| ***A47C 1/0355*** | (2013.01) |
| *A47C 1/035* | (2006.01) |

(52) U.S. Cl.

CPC ..... *A47C 1/0347* (2013.01); *A47C 1/02* (2013.01); *A47C 1/0355* (2013.01); *A47C 1/0352* (2013.01)

(58) Field of Classification Search

CPC .. A47C 1/0352; A47C 1/0347; A47C 1/0355; A47C 1/0345; A47C 1/02

USPC ..... 297/85 M, 342, 330, 68

See application file for complete search history.

(56) References Cited

U.S. PATENT DOCUMENTS

| | | | | |
|---|---|---|---|---|
| 3,499,344 | A | 3/1970 | Pickles | |
| 4,108,491 | A | 8/1978 | Rogers, Jr. | |
| 4,365,836 | A | 12/1982 | Jackson et al. | |
| 4,386,803 | A | 6/1983 | Gilderbloom | |
| 4,691,964 | A | 9/1987 | Morgan | |
| 4,696,512 | A | 9/1987 | Burnett et al. | |
| 4,929,024 | A | 5/1990 | Secord | |
| 4,989,914 | A | 2/1991 | Pine | |
| 5,271,660 | A | 12/1993 | LaPointe et al. | |
| 5,992,931 | A * | 11/1999 | LaPointe | A47C 1/0345 297/330 |
| 6,612,650 | B1 | 9/2003 | Ambrosio et al. | |
| 7,673,933 | B2 | 3/2010 | Lawson | |
| 8,201,877 | B2 * | 6/2012 | Hsieh et al. | 297/89 |
| 8,297,693 | B2 | 10/2012 | Hoffman et al. | |
| 8,419,122 | B2 * | 4/2013 | Lawson et al. | 297/85 M |
| 8,915,544 | B2 * | 12/2014 | LaPointe | 297/85 M |
| 2009/0174251 | A1 * | 7/2009 | Lawson | A47C 1/0355 297/85 R |
| 2011/0175404 | A1 | 7/2011 | Lawson | |
| 2013/0175847 | A1 * | 7/2013 | Lawson | 297/85 M |

* cited by examiner

*Primary Examiner* — Milton Nelson, Jr.

(74) *Attorney, Agent, or Firm* — Christensen Fonder P.A.

(57) ABSTRACT

A reverse drive assembly for recliner in which a motor is mounted at the end of the horizontal track, proximate to the rear of the recliner. A traveler assembly having a reverse transfer linkage having a greater bend is positioned along the track forward of the motor, wherein the traveler assembly actuates extension of an ottoman assembly and the reclining of a seat back.

20 Claims, 9 Drawing Sheets

REVERSE DRIVE ASSEMBLY FOR RECLINER POWER MECHANISM

PRIORITY CLAIM

This application claims priority to U.S. Provisional Application No. 61/708,993, filed Oct. 2, 2012 and U.S. Provisional Application No. 61/802,025, filed Mar. 15, 2013, each of which is hereby fully incorporated herein by reference.

FIELD OF THE INVENTION

The present invention is directed to a power mechanism for driving the movable elements of a recliner. Specifically, the present invention is directed to a power mechanism having a reverse drive assembly with the motor mounted proximate to the rear of the recliner to simplify manufacturing and assembly of the recliner.

BACKGROUND OF THE INVENTION

A recliner typically comprises a back rest that rotates downward to lower the user's back and head from an upright position to more a reclined position. Similarly, recliners also often comprise a deployable ottoman that has a leg rest that rotates outwardly to elevate the user's legs. Certain recliners often also shift the seat box forward to provide room behind the recliner for the lowered back rest. The recliners can also rotate the seat box to elevate the front of the seat box relative to the rear of the seat box to further position the user in a more comfortable reclined position. The back rest, ottoman and seat box of certain recliners are operably linked to a single rotating driving axle that is rotated by a drive assembly to move the various components such that the moving components can be operated simultaneously. The drive axle can also be moved horizontally to provide shift the seat box forward and extend the leg rest outwards from the seat box.

In operation, the drive axle is rotated in a first direction to lower back rest while rotating the leg rest of the ottoman into the reclined position. The drive axle can then be shifted forward to shift the seat box forward and extend the leg rest from the seat box of the recliner. The drive axle can then be shifted backwards and rotated in the opposite direction to return the moving components of the recliner to their original positions.

In certain recliners, such as shown in FIGS. 1-3, the drive axle is rotated by a traveler moved along a horizontal track perpendicular to drive axle by the drive assembly. The traveler is linked to the drive axle by elongated transfer linkages rotatably affixed to the drive axle via a bracket having an arm extending radially outward from the drive axle. As the traveler moves down the horizontal track, the horizontal motion of the traveler is translated into a pushing or pulling force applied tangential to the drive axle through the arm. The end of the arm and the end of the linkage are rotatably engaged such that the linkage and arm are generally parallel as the traveler initially moves down the horizontal track to apply the tangential force to the drive axle. The tangential force rotates the drive axle until the arm is generally parallel to the horizontal track. Once the arm is generally parallel to the horizontal track, angle between linkage and the arm collapses to apply a force to drive axle generally transverse to the drive axle to move the drive axle horizontally.

The drive assembly often comprises a motor at the end of the horizontal track proximate to the front of the recliner for pulling or pushing the traveler down the track. The front mounted motor is advantageous as the horizontal track is typically positioned beneath the seat box and remains fixed in place even as the various components of the recliner are moving. In particular, shifting the seat box forward to accommodate the reclining back rest can move the edges of the seat box such that the edges of the seat box intersect the horizontal track and motor. A front mounted motor provides more clearance for the motor to avoid the edge of the seat box as the seat box moves forward. Moreover, as the leg rest of the ottoman assembly typically defines the front face of the seat box, the simultaneous extension of the ottoman assembly provides a gap in the front of the seat box to provide additional clearance for the motor. Also, the elevation of the front portion of the seat box also reduces the likelihood that the seat box will become caught on the motor.

While a front mounted motor provides numerous advantages when operation the recliner, the inherent drawback of front mounted motors is that the motor placement is substantially more challenging to manufacture and assemble. A primary design consideration for motor powered recliners is positioning the wiring for the motor such that the power plug extends from the rear of the recliner. The rearward power plug reduces the likelihood that the plug will be tripped over and presents a more aesthetically appealing appearance. However, front mounting the motor requires that the wiring for the motor must be threaded through the plurality of linkages used to operate the moving parts to reach the motor from the rear of the recliner. The wiring must also be secured to prevent the wiring from catching on the linkages during operation of the assembly. The arduous task of threading and securing the wiring adds considerable time to the manufacturing process and can be easily done incorrectly resulting in damage to the wiring or linkages if the linkages engage an improperly secured or threaded wiring.

A similar drawback is that front mounted motors often results in the motor being visible from the front of the recliner through the opening left by the foot rest when the ottoman assembly is deployed. In addition to being aesthetically unpleasing, the exposed motor and/or wiring could become damaged.

As a result, there is a need for a means to operate a recliner that is reduces the time and difficulty required to manufacture the power mechanism for the recliner while maintaining an aesthetically pleasing appearance.

SUMMARY OF THE INVENTION

The present invention is directed to a recliner having a power mechanism comprising a drive axle and a reverse drive assembly in which the motor is mounted at the end of the horizontal track proximate to the rear of the recliner. The reverse drive assembly reduces the effort and time required to assemble and wire the recliner as the motor is positioned proximate to the rear of the recliner minimizing the distance between the power plug and the motor. As such, the wiring linking the motor to the power plug does not have to be threaded through the linkages of the recliner or secured to avoid engaging the linkages. Instead, the wiring can be directly attached to the motor without fear of the wiring being caught on the linkages during operation, thereby substantially reducing the time required to manufacture and assemble the recliner. Also, the rear mounted motor makes the motor less visible when the ottoman assembly is extended. Unlike conventional front mounted motors, the rear mounted motor of the present invention protrudes from the rear of the recliner rather than the front of the recliner when the seat box is shifted forward such that the motor is less visible and less likely to be damaged.

The reverse drive assembly can also further comprise at least one "reverse" transfer linkage bent at a predetermined angle. In operation, the reverse drive assembly must rotate the drive axle a predetermined rotational distance to operate the ottoman assembly and back rest. The reverse transfer linkage is bent further than conventional linkages such that the traveler requires shorter horizontal travel distance to rotate the drive axle the necessary rotational distance. In one aspect, the predetermined angle can comprise a 110 to 150 degree angle. In yet another aspect, the predetermined angle can be bent to comprise a 130 degree angle. The reverse mounted motor allows for a deeper bend in the linkage as the rear mounted motor does not interfere with the transfer linkages as the traveler moves along the horizontal track. In particular, as the traveler approaches the end of the track, the linkage extends over the end of the track potentially impacting a front mounted motor.

Moreover, the shorter horizontal travel distance allows for a shorter horizontal track providing clearance at the rear of the horizontal track for the motor to be rear mounted with sufficient clearance for the seat box. As the drive axle must be moved a predetermined distance horizontally, the length of the horizontal track that must traveled by the traveler to push the drive axle the necessary horizontal distance cannot be shortened. Accordingly, only the length of the horizontal track for rotating the drive axle can be shortened. The bend in the reverse transfer linkage is set to shorten the length of the horizontal track corresponding to rotation of the drive axle such that the motor can be placed behind the traveler.

A power mechanism, according to an embodiment of the present invention, can comprise a drive axle, a reverse drive assembly, a horizontal track and a traveler. The reverse drive assembly can further comprise a motor and a worm gear positionable within the horizontal track and rotatable by the motor to move the traveler along the horizontal track. The motor is affixed to one end of the horizontal track, wherein the horizontal track is positioned perpendicular to a rotatable drive axle for a recliner such that the motor is positioned proximate to the rear of the recliner. The traveler can further comprise at least one reverse transition linkage having an L-shaped bracket at one end of the linkage for rotatably engaging the linkage to the drive axle.

In one aspect, the horizontal track can define a first segment corresponding to the length of the horizontal track that is traveled by the traveler to rotate drive axle a predetermined rotational distance and define a second segment corresponding to the length of the horizontal track traveled by the traveler to move the drive axle a predetermined horizontal distance. The predetermined rotational distance corresponds to the necessary rotation for the drive axle to extend the ottoman assembly and/or recline the back rest. The predetermined horizontal distance corresponds to the horizontal distance the seat box is shifted forward to provide clearance for the reclining back rest. In this configuration, each reverse transfer linkage is bent at a predetermined angle to shorten the first segment of the horizontal track enough to provide at least enough clearance at the rear of the horizontal track to mount the motor at the rear of the horizontal track while still rotating the drive axle the necessary rotational distance.

A recliner, according to an embodiment of the present invention, comprises a seat box, a back rest, an ottoman assembly, a base and a power mechanism. The power mechanism comprises a drive axle rotated and moved horizontally by a traveler traveling along a horizontal track. The drive axle is rotatably mounted to the seat box, wherein moving the drive axle horizontally with the traveler shifts the seat box horizontally with the drive axle. In one aspect, the seat box can further comprise a notch in the rear edge of the seat box to provide clearance for the rear-mounted motor as the seat box slides forward. Similarly, the ottoman assembly further comprises a leg rest and at least one scissor linkage assembly having a lever linkage engaged to the drive axle such that rotating the drive axle extends the scissor linkage assembly to position the leg rest generally parallel to the top of the seat rest.

The above summary of the various representative aspects of the invention is not intended to describe each illustrated aspect or every implementation of the invention. Rather, the aspects are chosen and described so that others skilled in the art can appreciate and understand the principles and practices of the invention. The figures in the detailed description that follow more particularly exemplify these aspects.

Still other objects and advantages of the present invention and methods of construction of the same will become readily apparent to those skilled in the art from the following detailed description, wherein only the preferred embodiments are shown and described, simply by way of illustration of the best mode contemplated of carrying out the invention. As will be realized, the invention is capable of other and different embodiments and methods of construction, and its several details are capable of modification in various obvious respects, all without departing from the invention. Accordingly, the drawing and description are to be regarded as illustrative in nature, and not as restrictive.

BRIEF DESCRIPTION OF THE DRAWINGS

The invention can be completely understood in consideration of the following detailed description of various embodiments of the invention in connection with the accompanying drawings, in which.

Figure 1:
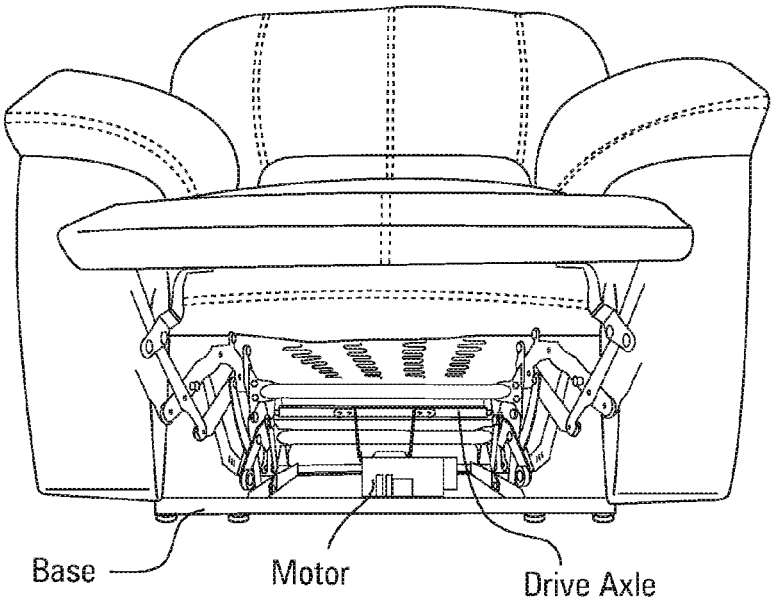
Fig. 1 Prior Art
FIG. 1 is a front view of a conventional recliner having a drive assembly with a front mounted motor.
Figure 2:
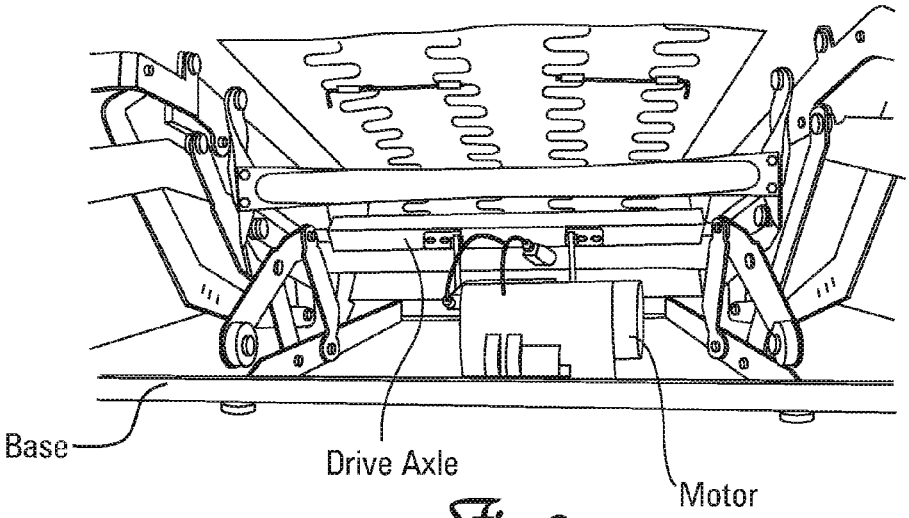
Fig. 2 Prior Art
FIG. 2 is a partial front view of the drive assembly of the conventional recliner depicted in FIG. 1.
Figure 3:
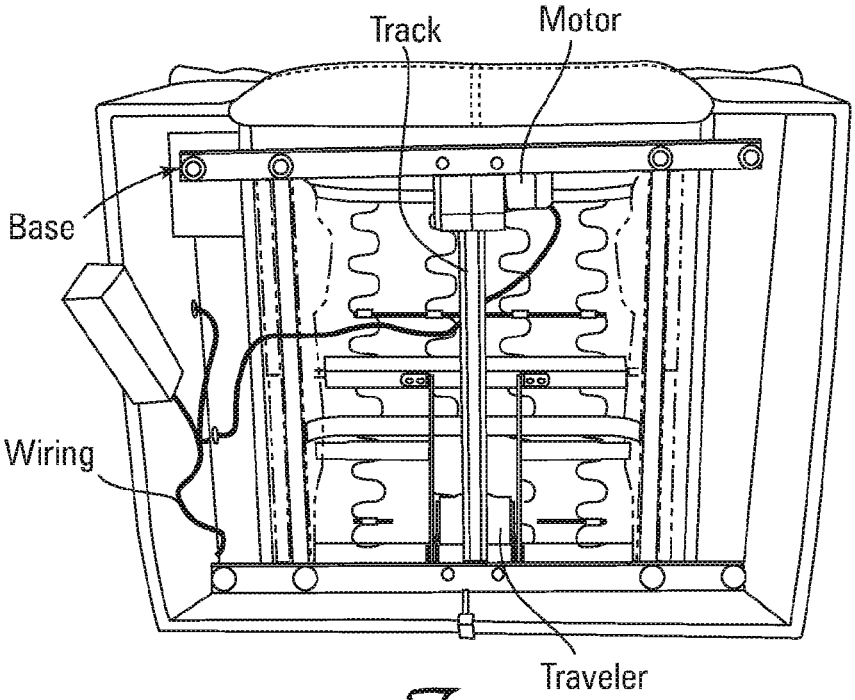
Fig. 3 Prior Art
FIG. 3 is a bottom view of the conventional recliner depicted in FIG. 1.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Figure 4:
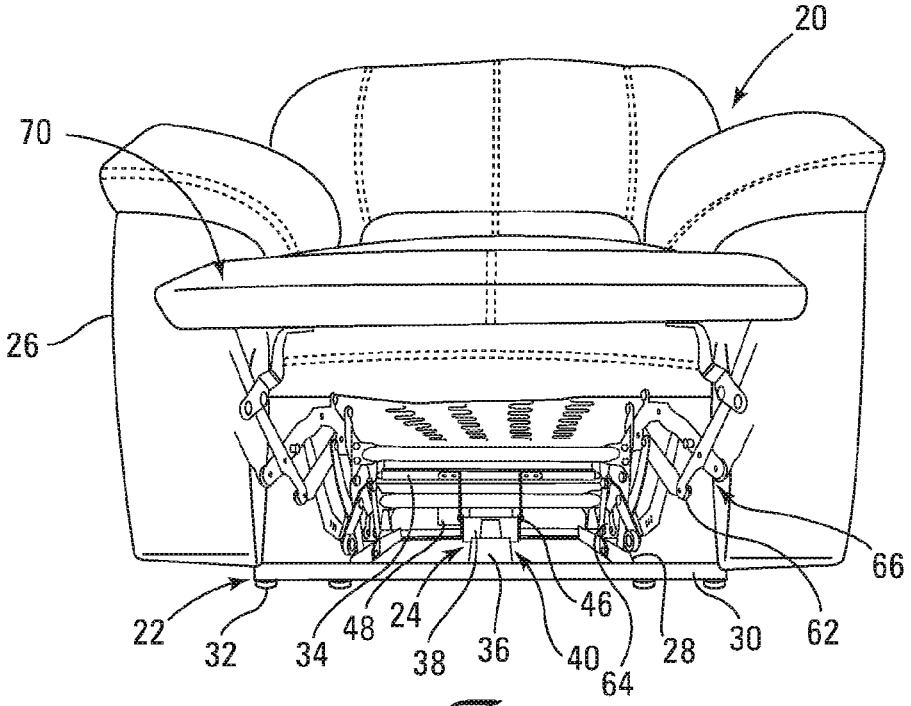
FIG. 4 is a front view of a conventional recliner having a drive assembly according to an embodiment of the invention.
Figure 5:
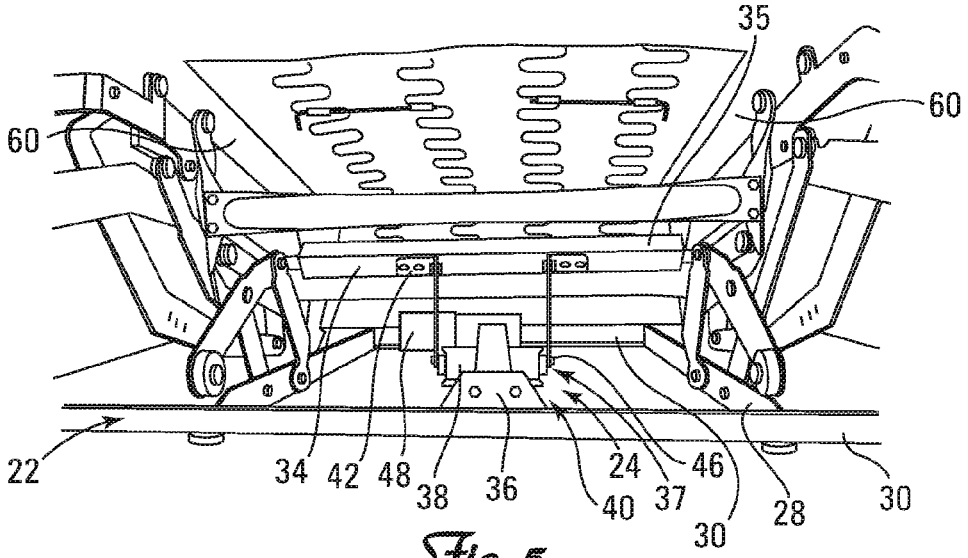
FIG. 5 is a partial front view of the drive assembly of the recliner depicted in FIG. 4.
Figure 6:
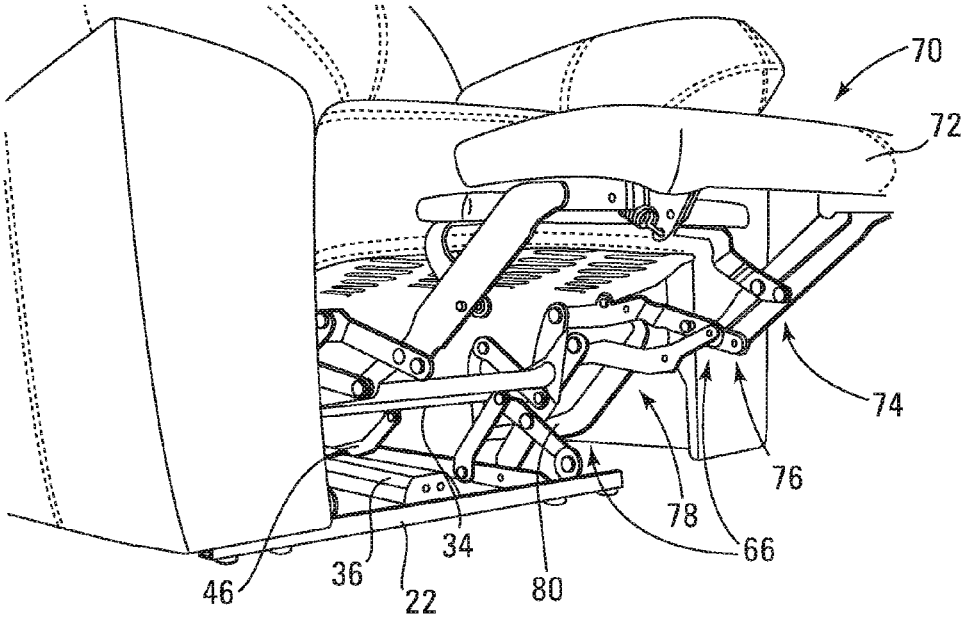
FIG. 6 is a partial front perspective view of recliner depicted in FIG. 4.

As shown in FIGS. 4-6, a recliner 20, according to an embodiment of the present invention, comprises a base 22, a power mechanism 24 and a seat box 26. The base 22 further comprises at least two longitudinal rails 28 each intersected with at least two end rails 30 to define a generally rectangular frame for supporting the recliner 20. The base 22 is adapted to be positioned on the ground beneath the recliner 20 and support the recliner 20 during the operation of the recliner 20. In one aspect, the base 22 can further comprise at least one positioning wheel 32 for changing the orientation of the recliner 20.

Figure 9:
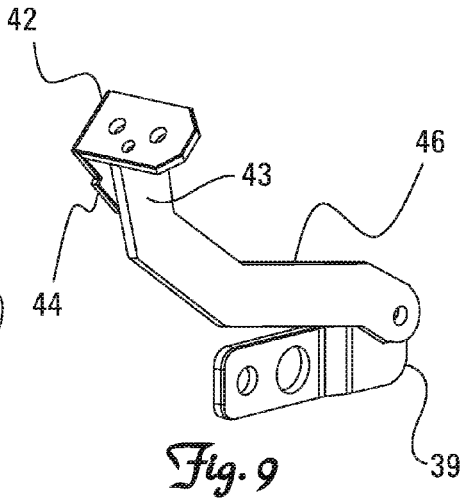
FIG. 9 is a perspective view of a reverse transfer linkage used with a rear mounted motor according to an embodiment of the present invention.
Figure 10:
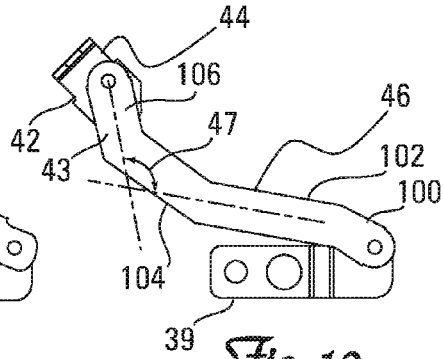
FIG. 10 is a side view of the reverse transfer linkage depicted in FIG. 9.
Figure 11:
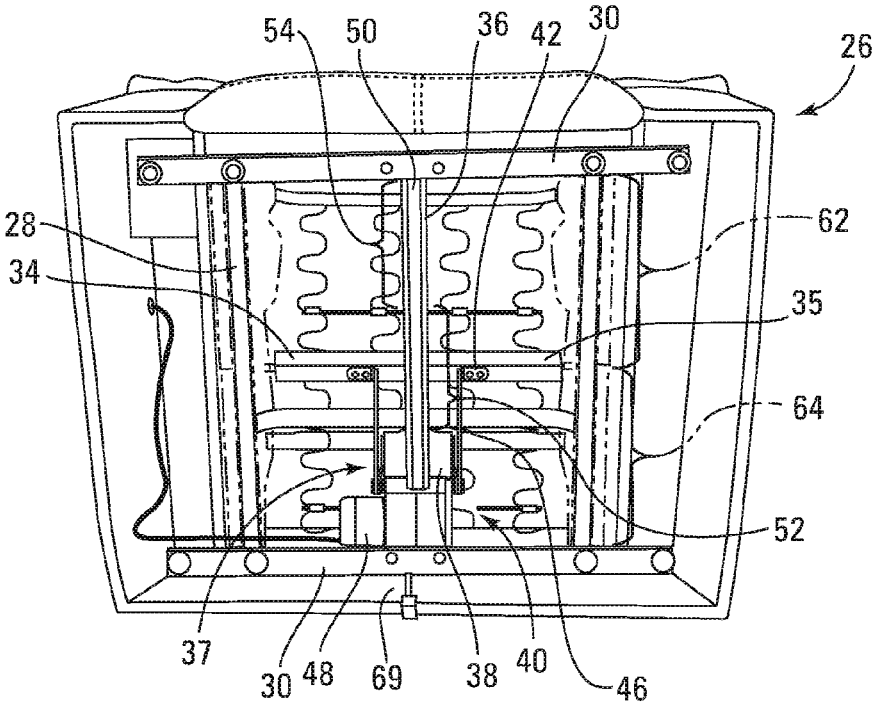
FIG. 11 is a bottom view of the recliner depicted in FIG. 4.

As shown in FIG. 11, the power mechanism 24 further comprises a drive axle 34, a horizontal track 36, a traveler assembly 37 and a reverse drive assembly 40. The drive axle 34 can further comprise a crossbar 35, which is preferably square in cross-section, and a bracket 42, as seen in FIGS. 9 and 10, having an arm portion 44. The bracket 42 is operably mounted to the crossbar 35, such that the arm portion 44 extends radially outward from the crossbar 35. Applying a pushing or pulling force to the arm portion 44 tangentially causes the drive axle 34 to rotate. The traveler assembly 37 comprises a traveler 38 and at least one reverse transfer linkage 46 rotatably affixed to the traveler 38 via a bracket link 39 at one end and rotatably affixed to the arm portion 44 at point 43 at the opposite end.

Figure 7:
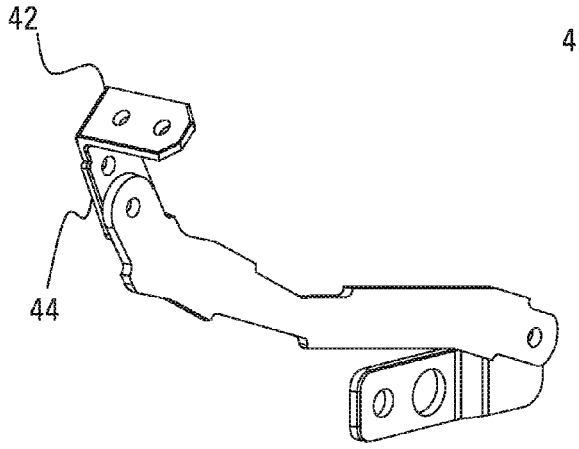
Fig. 7 Prior Art
FIG. 7 is a perspective view of a conventional transfer linkage used with a front mounted motor.
Figure 8:
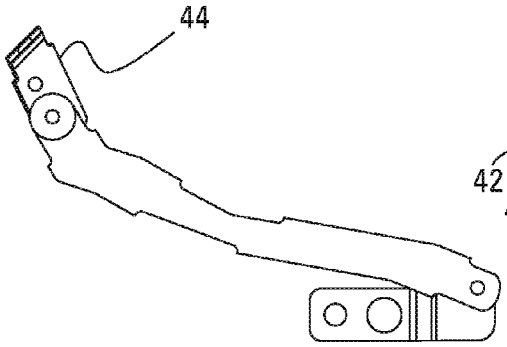
Fig. 8 Prior Art
FIG. 8 is a side view of the conventional transfer linkage depicted in FIG. 7.

As shown in FIGS. 9-10, each transfer linkage 46 is bent at a predetermined angle. In an embodiment of the transfer linkage 46, the transfer linkage 46 comprises substantially straight segments, including a proximal end segment 100, which is rotatably affixed to the bracket link 39, a primary segment 102, a secondary segment 104, and a distal end segment 106 rotatably affixed to the arm portion 44. In one aspect, the predetermined angle 47 of the transfer linkage 46 between the segments 102 and 106 is about 110 degrees, whereas a conventional transfer linkage is typically linear or nearly linear as shown in FIGS. 7-8. In some aspects of the invention, the angle 47 may be within the range of about 110 to 130 degrees. The reverse drive assembly 40 can further comprise a motor 48 and a worm gear 50 positioned within the horizontal track 36. The horizontal track 36 is mounted to the end rails 30 such that the horizontal track 36 extends between the end rails 30 in parallel to the longitudinal rails 28. The motor 48 is positioned at the end of the horizontal track 36 proximate to the rear of the seat box 26. In one aspect, the horizontal track 36 defines a first segment 52 and a second segment 54.

In operation, the traveler 38 is operably engaged to the worm gear 50, such that rotation of the worm gear 50 by the motor 48 in a first direction pushes the traveler 38 down the horizontal track 36 in the first direction, toward the front of the recliner 20. Rotating the worm gear 50 in the opposite second direction pulls the traveler 38 in the opposite direction. Moving the traveler 38 in the first direction through the first segment 52 applies a tangential pushing force to the arm portion 44 to rotate the drive axle 34 in a first direction until the drive axle 34 has rotated a predetermined rotational distance. The drive axle 34 remains substantially longitudinally fixed relative to the traveler 38 during longitudinal movement of the traveler 38. The length of the first segment 52 corresponds to the necessary horizontal travel distance of the traveler 38 to rotate the drive axle 34 the necessary rotational distance. This distance substantially effectuates to the extension of the ottoman assembly 70. Continuing the movement of the traveler 38 into the second segment 54 maintains the rotation of the drive axle 34, in that the drive axle 34 substantially ceases rotation, while applying an axial pull force to the arm portion 44 to move the drive axle 34 horizontally with the traveler 38. Similarly, moving the traveler 38 in the second direction through the second segment 54 moves or pushes the drive axle 34 horizontally in the opposite direction until the traveler 38 reaches the first segment 52. Pulling the traveler 38 in the second direction through the first segment 52 applies a tangential pulling force to the arm portion 44 to rotate the drive axle 34 in an opposite second direction until the drive axle 34 is returned to the original position.

The seat box 26 further comprises a box frame 60, at least two forward swing linkage assemblies 62 and at least two rear swing linkages 64. Each forward swing linkage assembly 62 comprises scissoring linkages 66 movable between a generally bent orientation and a generally elongated orientation. The seat box 26 also further comprises at least one drive axle bracket 68 for rotatably receiving the drive axle 34. In the embodiment shown, the drive axle bracket further serves as the seat mounting plate. As shown in FIG. 6, the two forward swing linkage assemblies 62 are each rotatably affixed at one end to the box frame 60 proximate to the front of the seat box 26 and rotatable affixed to the corresponding longitudinal rail 28 at the opposite end proximate to the front of the base 22. Similarly, the two rear swing linkages 64 are rotatable affixed at one end to the box frame 60 proximate to the rear of the seat box 26 and rotatable affixed to the corresponding longitudinal rail 28 at the opposite end proximate to the rear of the base 22.

In operation, moving the traveler 38 in the first direction through the second segment 54 moves the seat box 26 forward relative to the base 22. As shown in FIG. 6, moving the seat box 26 forward relative to the base 22 extends the scissoring linkages 66 of the forward swing assemblies 62 to elevate front of the seat box 26 as the seat box 26 moves forward. Similarly, moving the traveler 38 in the second direction through the second segment 54 moves the seat box 26 backwards relative to the base 22 and folds the scissoring linkages 66 to return the seat box 26 to the original orientation. In one aspect, the seat box 26 can further define a notch or opening 69 in the rear of the seat box 26 such that the edge of the seat box 26 does not engage the motor 48 as the seat box 26 is moved forward with the lowered rear end.

As shown in FIGS. 4-6, the recliner 20 further comprises an ottoman assembly 70 integrated into the seat box 26. The ottoman assembly 70 comprises a leg rest 72, an extension assembly 74 having a plurality of scissoring linkages 76, and a lever assembly 78. The scissoring linkages 76 of the extension assembly 74 are adapted to rotate the leg rest 72 such that the leg rest 72 is generally parallel to the top of the seat box 26. The lever assembly 78 further comprises a transfer linkage 80 and a lever linkage 82. The lever linkage 82 is operably engaged to drive axle 34 such that rotating the drive axle 34 rotates the lever linkage 82. The transfer linkage 80 is operably engaged to the lever linkage 82 and extends between the lever linkage 82 and the leg rest 72 to transfer the rotation of the drive axle 34 to a corresponding movement in the leg rest 72 via the extension assembly 74. In one aspect, the leg rest 72 defines the front the seat box 26.

In operation, moving the traveler 38 through the first segment 52 in the first direction rotates the drive axle 34 in the first direction applying a pushing force on the leg rest 72 through the lever assembly 78 to extend the extension assembly 74 and position the leg rest 72 in an orientation generally parallel to the top of the seat box 26. Similarly, moving the traveler 38 in the second direction through the first segment 52 rotates the drive axle 34 in the second direction applying a pulling force on the leg rest 72 through the lever assembly 78 to retract the extension assembly 74 to return the leg reset 72 to the original position. In one aspect, the ottoman assembly 74 can be mounted to the seat box 26 on a floating assembly such that the horizontal movement of the drive axle 34 extends the leg rest 72 out from the seat box 26.

Figure 12:
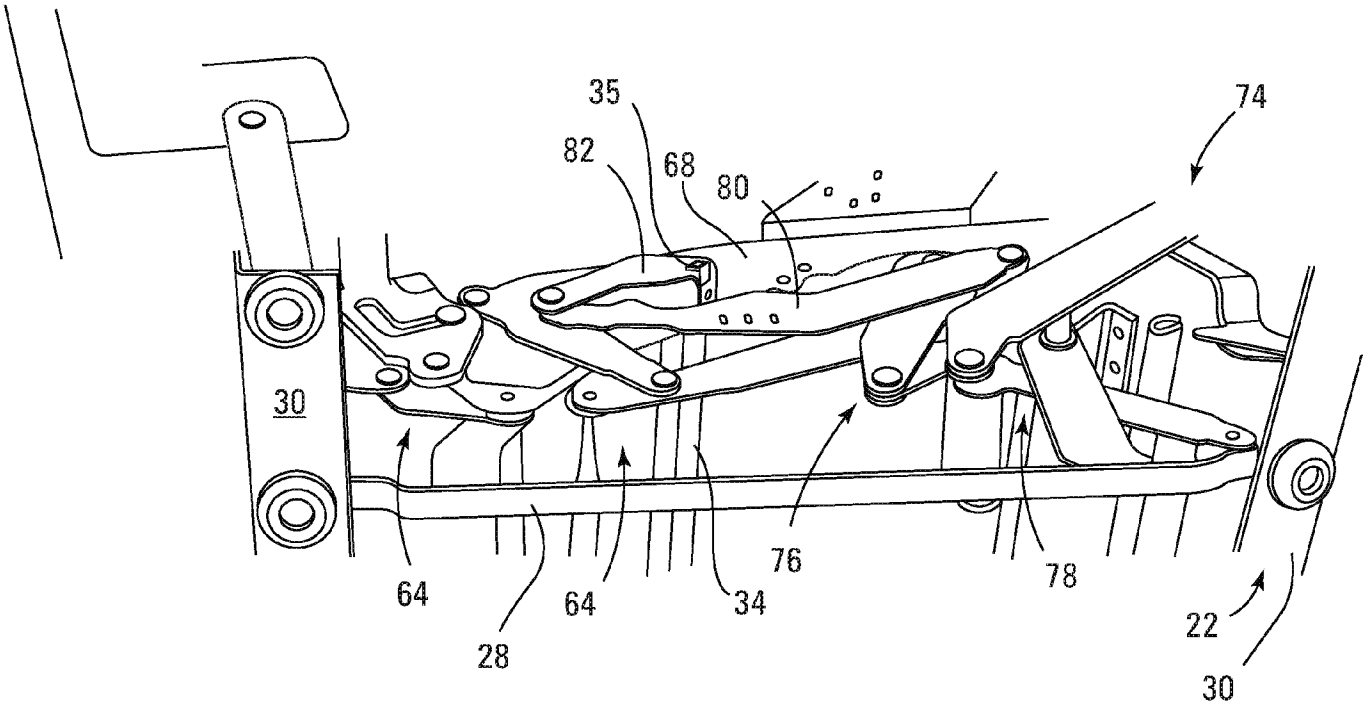
FIG. 12 is a partial side perspective view of the swing linkages of the recliner when the ottoman assembly is in its closed position.
Figure 13:
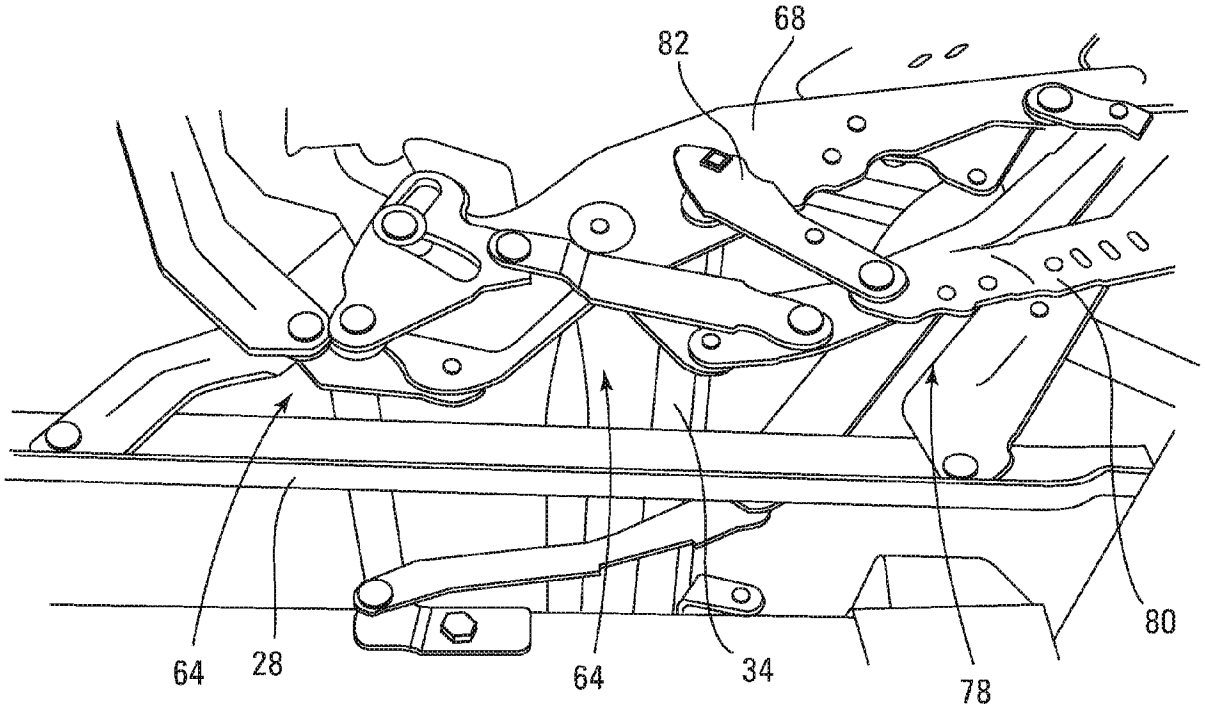
FIG. 13 is a partial side perspective view of the swing linkages of the recliner when the ottoman assembly is in its extended position.
Figure 14:
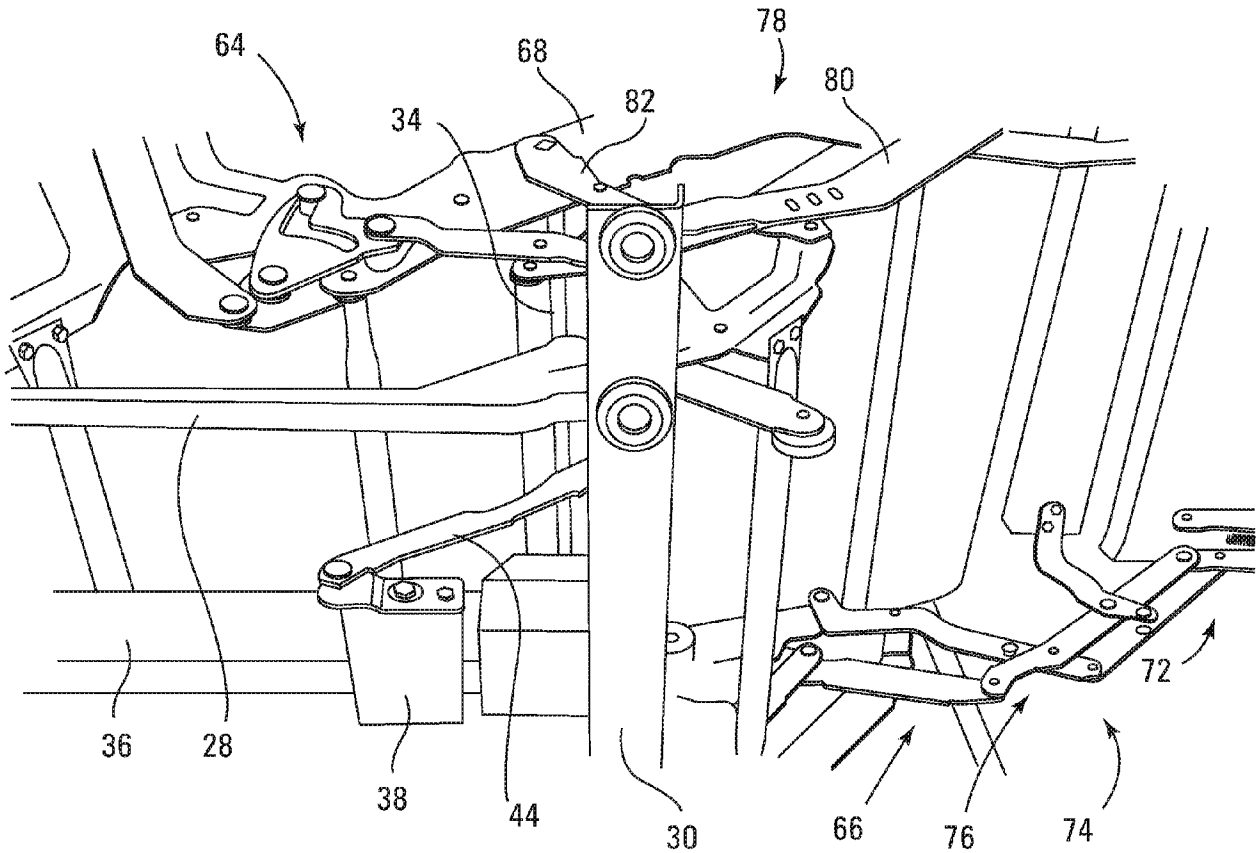
FIG. 14 is a partial side perspective view of the swing linkages of the recliner when the ottoman assembly is in its extended position and the seat back is reclined.

FIGS. 12-14 are partial side perspective views of the swing linkages of the recliner when the ottoman assembly is in its closed position, extended position and extended position with the seat back is reclined, respectively. From the closed position to the extended position, the traveler assembly moves through the first segment of the track. As the traveler assembly goes through the second segment, the seat back is reclined.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

REFERENCES

| | | |
|---|---|---|
| U.S. Pat. No. 8,297,693 | U.S. Pat. No. 7,673,933 | U.S. Pat. No. 4,386,803 |
| U.S. Pat. No. 4,365,836 | U.S. Pat. No. 4,696,512 | U.S. Pat. No. 6,612,650 |
| US Pub 3499344 | U.S. Pat. No. 4,929,024 | U.S. Pat. No. 4,691,964 |

The above references in all sections of this application are herein incorporated by references in their entirety for all purposes. For purposes of interpreting the claims for the present invention, it is expressly intended that the provisions of Section 112, sixth paragraph of 35 U.S.C. are not to be invoked unless the specific terms "means for" or "step for" are recited in a claim All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A recliner, comprising:

a seat box having a front and a back;

a base defining a frame positioned under the seat box, the frame having a front portion and a back portion; and a power mechanism for powering a change in orientation of the recliner, wherein the power mechanism comprises a track having an axis, a first end and a second end, wherein the axis of the track runs from the front portion to the back portion of the frame and the first end is fixed to the hack portion and the second end is fixed to the front portion;

a traveler being movable along the track; and a drive assembly, the drive assembly comprising a motor, wherein the motor is positioned adjacent to the back portion, such that the traveler is positioned between the motor and the front portion, relative to the axis of the track, wherein the motor drives the traveler to effectuate the change in orientation of the recliner.

2. The recliner of claim 1, the base defining a generally rectangular frame comprising two longitudinal rails running parallel with the track and a front rail and a back rail, each intersecting with the two longitudinal rails, wherein the first end of the track is secured to the back rail and the second end is secured to the front rail.

3. The recliner of claim 1, further comprising a drive axle oriented substantially perpendicular with the track axis and the power mechanism further comprising a transfer linkage, wherein a first end of the transfer linkage is rotatably affixed to the traveler and a second end is rotatably affixed to the drive axle and wherein movement of the traveler along a portion of the track applies a force on the drive axle effectuating a rotation of the drive axle, which in turn effectuates a change in orientation of the recliner.

4. The recliner of claim 3, wherein the drive assembly further comprises a worm gear positioned within the track, wherein the worm gear moves the traveler.

5. The recliner of claim 3, wherein, in operation, the traveler is operably engaged to a worm gear, such that rotation of the worm gear by the motor in a first direction pushes the traveler in a first track direction, while rotating the worm gear in a second direction opposite the first direction pulls the traveler in a second track direction, wherein moving the traveler from a first position in the first track direction through the a first segment applies a tangential pushing force to the crossbar to rotate the drive axle in a first rotating direction until the drive axle has rotated a predetermined rotational distance, the length of the first segment corresponding to a travel distance of the traveler along the track necessary to rotate the drive axle the predetermined rotational distance, and continuing movement of the traveler into a second segment maintains the rotation of the drive axle while applying an axial pull force to the crossbar to move the drive axle horizontally with the traveler, and wherein moving traveler in a second track direction through the second segment moves the drive axle horizontally in the second track direction until the traveler reaches the first segment, wherein pulling the traveler in the second track direction through the first segment applies a tangential pulling force to the crossbar to rotate the drive axle in a second rotating direction until the drive axle is returned to the first position.

6. The recliner of claim 3, the seat box further comprising a box frame, two forward swing linkage assemblies and two rear swing linkages, each forward swing linkage assembly comprising scissoring linkages movable between a generally bent orientation and a generally elongated orientation, and wherein the seat box further comprises at least one drive axle bracket for rotatably receiving the drive axle, wherein the two forward swing linkage assemblies are each operably rotatably affixed at a first end to the box frame proximate to the front of the seat box and rotatably affixed to a corresponding longitudinal rail of the base at a second end proximate to the front portion of the base.

7. The recliner of claim 3, the recliner further comprising an ottoman assembly integrated into the seat box, wherein the ottoman assembly comprises a leg rest, an extension assembly having a plurality of scissoring linkages, and a lever assembly, the traveler actuating the ottoman assembly upon movement along the track.

8. The recliner of claim 3, wherein the power mechanism comprises two transfer linkages rotatably affixed to the traveler and rotatably affixed to the drive axle.

9. The recliner of claim 8, wherein the transfer linkages are bent at a predetermined angle and the predetermined angle is a 110 to 130 degree angle.

10. The recliner of claim 3, wherein the transfer linkage is bent at a predetermined angle.

11. The recliner of claim 10, wherein the predetermined angle for the transfer linkage is a 110 to 130 degree angle.

12. The recliner of claim 10, wherein the predetermined angle for the transfer linkage is about 110 degrees.

13. The recliner of claim 3, the drive axle comprising a crossbar oriented transverse to the track and a bracket having an arm portion, wherein the bracket is fixedly mounted to the crossbar and the arm portion extends radially outward from the crossbar, such that applying a pushing or pulling force to the arm portion tangentially to the crossbar rotates the drive axle.

14. The recliner of claim 13, wherein the track defines a first segment and a second segment, in effectuating the change in orientation of the recliner, the traveler moves along the track from a position adjacent to the motor, through the first segment and then the second segment to the front portion, wherein, when the traveler moves in the first segment, the drive axle rotates and the crossbar remains substantially longitudinally fixed relative to the traveler, and, when the traveler moves in the second segment, the crossbar moves longitudinally with the traveler.

15. The recliner of claim 14, the movement of the traveler in the first segment effectuates extension of a leg rest and the movement of the traveler in the second segment effectuates reclining of a back rest.

16. A recliner having a front portion and a back portion, comprising a power mechanism for powering a change in orientation of the recliner, wherein the power mechanism comprises a track having an axis, a first end and a second end, wherein the axis of the track runs from the front portion to the back portion of the recliner and the first end is fixed to the back portion and the second end is fixed to the front portion;

a traveler being movable along the track; and a drive assembly, the drive assembly comprising a motor, wherein the motor is positioned adjacent to the back portion, such that the traveler is positioned between the motor and the front portion, relative to the axis of the track, wherein the motor drives the traveler to effectuate the change in orientation of the recliner.

17. The recliner of claim 16, further comprising a drive axle oriented substantially perpendicular with the track axis and the power mechanism further comprising a transfer linkage, wherein a first end of the transfer linkage is rotatably affixed to the traveler and a second end is rotatably affixed to the drive axle and wherein movement of the traveler along a portion of the track applies a force on the drive axle effectuating a rotation of the drive axle, which in turn effectuates a change in orientation of the recliner.

18. The recliner of claim 17, the drive axle comprising a crossbar oriented transverse to the track and a bracket having an arm portion, wherein the bracket is fixedly mounted to the crossbar and the arm portion extends radially outward from the crossbar, such that applying a pushing or pulling force to the arm portion tangentially to the crossbar rotates the drive axle.

19. The recliner of claim 17, wherein the transfer linkage is bent at a predetermined angle, wherein the predetermined angle for the transfer linkage is a 110 to 130 degree angle.

20. The recliner of claim 19, wherein the predetermined angle for the transfer linkage is about 110 degrees.

* * * * *